US011105497B1

(12) United States Patent
Hsu

(10) Patent No.: US 11,105,497 B1
(45) Date of Patent: Aug. 31, 2021

(54) MULTIFUNCTIONAL TRACK TYPE LAMP HOLDER ASSEMBLY

(71) Applicant: Dong Guan Jia Sheng Lighting Technology Co., Ltd. China, Dong-Guna (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/922,159

(22) Filed: Jul. 7, 2020

(51) Int. Cl.
*F21V 21/34* (2006.01)
*F21V 21/08* (2006.01)

(52) U.S. Cl.
CPC ..... *F21V 21/34* (2013.01); *F21V 21/0824* (2013.01)

(58) Field of Classification Search
CPC .... F21V 21/34; F21V 21/0824; F21V 21/005; F21V 21/35; F21S 4/20; F21S 4/28
See application file for complete search history.

(56) References Cited

U.S. PATENT DOCUMENTS 4,410,157 A * 10/1983 Monti ..... F16M 11/10 248/125.8
5,217,298 A * 6/1993 Jackson ..... F21S 6/006 362/249.01
5,702,177 A * 12/1997 Lin ..... F21S 8/038 362/370
6,059,582 A * 5/2000 Tsai ..... H01R 25/142 362/287
10,113,726 B1 * 10/2018 Veloskey ..... F21V 21/30
2002/0190859 A1 * 12/2002 Bucher ..... F21V 21/0824 340/541
2005/0254262 A1 * 11/2005 Chiu ..... F21V 21/35 362/648
2007/0029459 A1 * 2/2007 Hanson ..... E04H 12/2253 248/530
2007/0091585 A1 * 4/2007 Hedman ..... F21V 21/0824 362/96
2007/0171655 A1 * 7/2007 Lai ..... F21V 21/0824 362/362
2009/0244925 A1 * 10/2009 Snagel ..... H01R 25/142 362/648
2011/0163341 A1 * 7/2011 Van Elmpt ..... F21V 29/70 257/98

(Continued)

*Primary Examiner* — Jong-Suk (James) Lee
*Assistant Examiner* — James M Endo
(74) *Attorney, Agent, or Firm* — Karin L. Williams; Alan D. Kamrath; Mayer & Williams PC

(57) ABSTRACT

A lamp holder assembly includes a support post, and a plurality of fixtures mounted on the support post. The support post includes a main body and a securing portion. The main body has a plurality of entrance slots. Each of the entrance slots has two limit grooves. Each of the fixtures includes a mounting head and a locking member. The locking member is inserted into each of the entrance slots and is introduced from each of the entrance slots into the two limit grooves of each of the entrance slots by rotation of each of the fixtures, and is locked in the two limit grooves of each of the entrance slots. The locking member is provided with two pressing pieces. When each of the fixtures is rotated, the pressing pieces are locked into the limit grooves of each of the entrance slots.

8 Claims, 5 Drawing Sheets

(56) References Cited

U.S. PATENT DOCUMENTS

| | | | | |
|---|---|---|---|---|
| 2015/0024615 | A1* | 1/2015 | Lindblom | H01R 13/625 439/121 |
| 2016/0069519 | A1* | 3/2016 | Li | F21K 9/27 362/225 |
| 2016/0104985 | A1* | 4/2016 | Ewing | F21V 33/0012 211/26 |
| 2017/0130943 | A1* | 5/2017 | Xu | F21V 21/14 |

* cited by examiner

MULTIFUNCTIONAL TRACK TYPE LAMP HOLDER ASSEMBLY

BACKGROUND OF THE INVENTION

1. Field of the Invention

The present invention relates to a support rack and, more particularly, to a lamp holder assembly for an illuminating apparatus.

2. Description of the Related Art

A lamp holder is used to mount and hold a lamp. In assembly, the lamp holder is affixed to a predetermined position. Then, the lamp is mounted on the lamp holder. Thus, the lamp is installed on the predetermined position by the lamp holder. However, the conventional lamp holder is used to hold a single lamp only, such that it is necessary to provide multiple lamp holders for mounting multiple lamps, thereby increasing the cost. In addition, the multiple lamp holders occupy a larger area.

BRIEF SUMMARY OF THE INVENTION

The primary objective of the present invention is to provide a multifunctional track type lamp holder assembly.

In accordance with the present invention, there is provided a lamp holder assembly comprising a support post, and a plurality of fixtures mounted on the support post. The support post includes a main body and a securing portion extending from a bottom of the main body. The main body has a periphery provided with a plurality of entrance slots. Each of the entrance slots has two limit grooves formed on two sidewalls thereof. Each of the fixtures includes a mounting head and a locking member. The locking member has a width less than a slot width of each of the entrance slots, with the locking member being introduced into each of the entrance slots in a direction. The locking member has a length more than the slot width of each of the entrance slots and less than a distance between the two limit grooves of each of the entrance slots, with the locking member being introduced from each of the entrance slots into the two limit grooves of each of the entrance slots by rotation of each of the fixtures, and being locked in the two limit grooves of each of the entrance slots. The locking member is provided with two pressing pieces. The two pressing pieces have a thickness increased gradually from a first end toward a second end thereof in the same rotation direction. When each of the fixtures is rotated, the two pressing pieces of the locking member are locked into the two limit grooves of each of the entrance slots, and each of the fixtures is tightened gradually by a gradual increase in the thickness of the two pressing pieces.

According to the primary advantage of the present invention, the lamp holder assembly is used to hold multiple lamps simultaneously without having to provide multiple lamp holders, thereby decreasing the cost.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
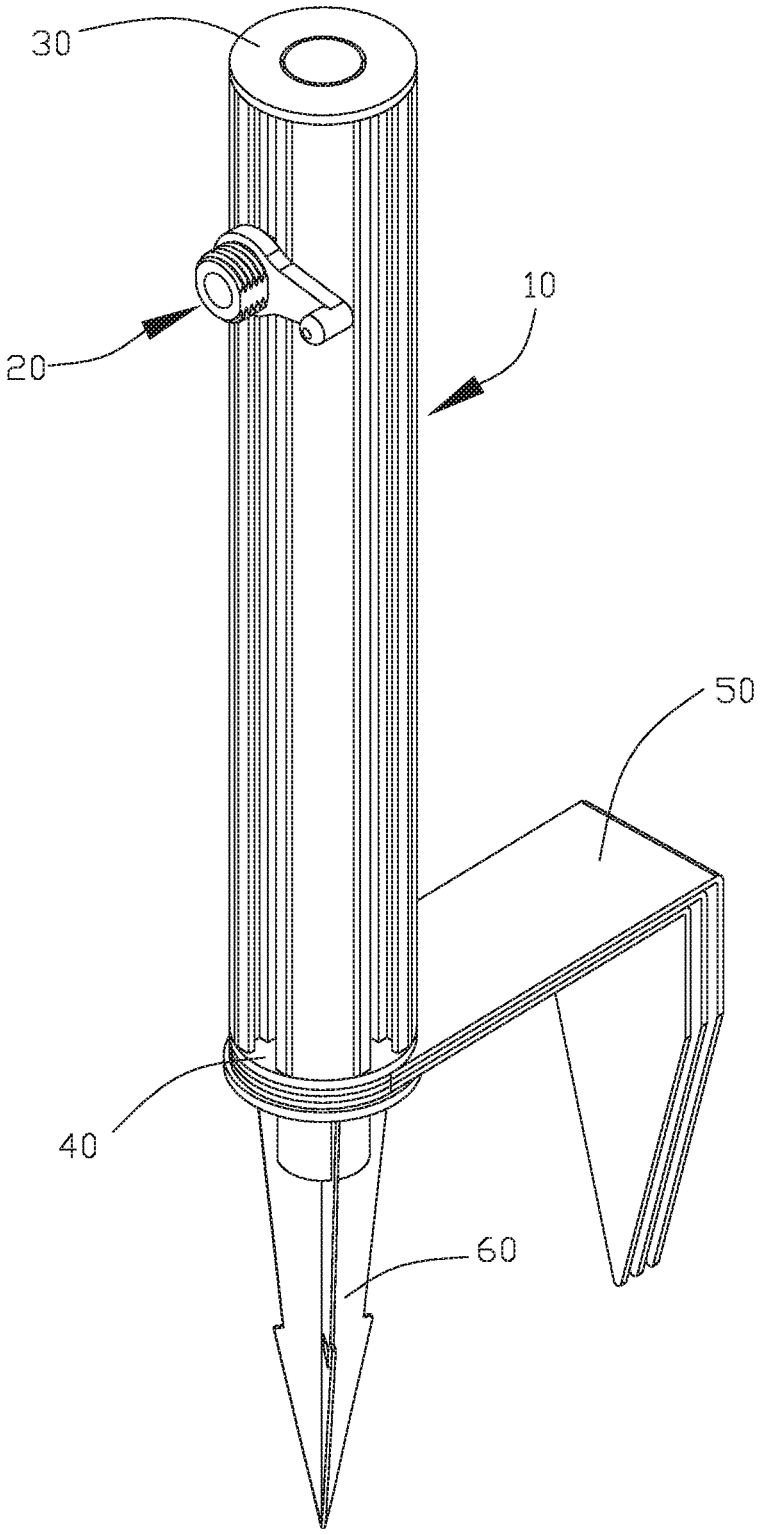
FIG. 1 is a perspective view of a lamp holder assembly in accordance with the preferred embodiment of the present invention.
Figure 2:
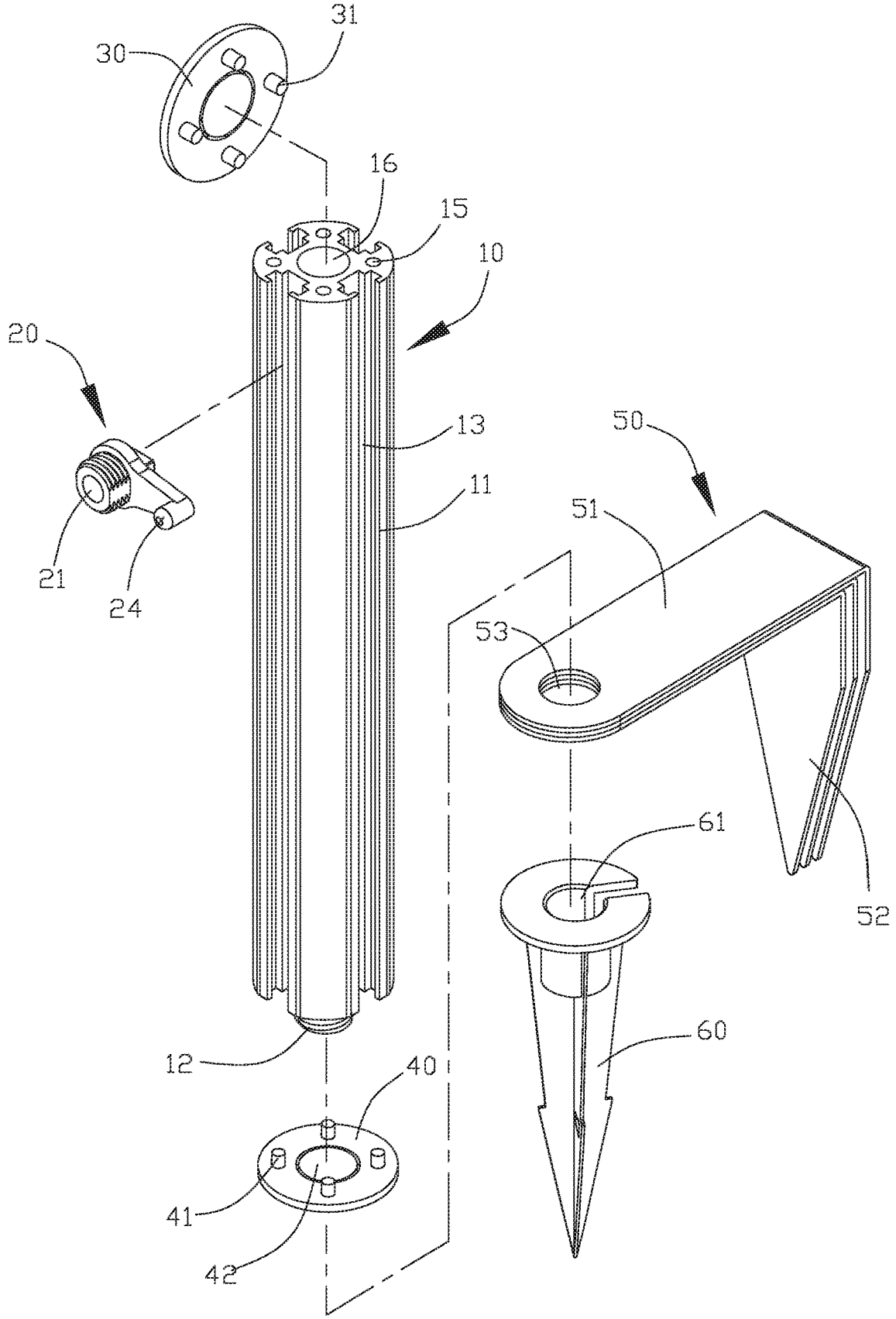
FIG. 2 is an exploded perspective view of the lamp holder assembly in accordance with the preferred embodiment of the present invention.
Figure 3:
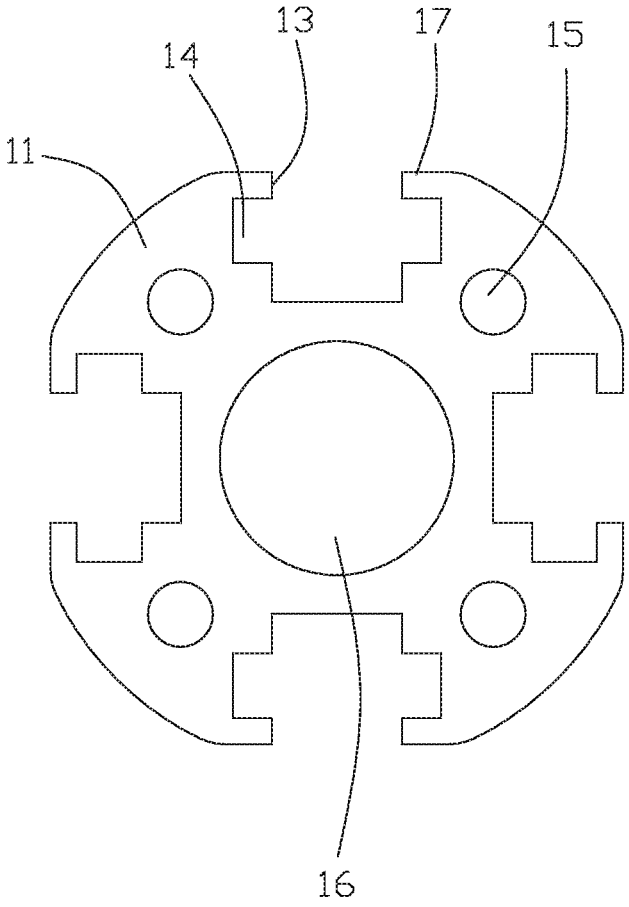
FIG. 3 is a top view of a support post of the lamp holder assembly in accordance with the preferred embodiment of the present invention.
Figure 4:
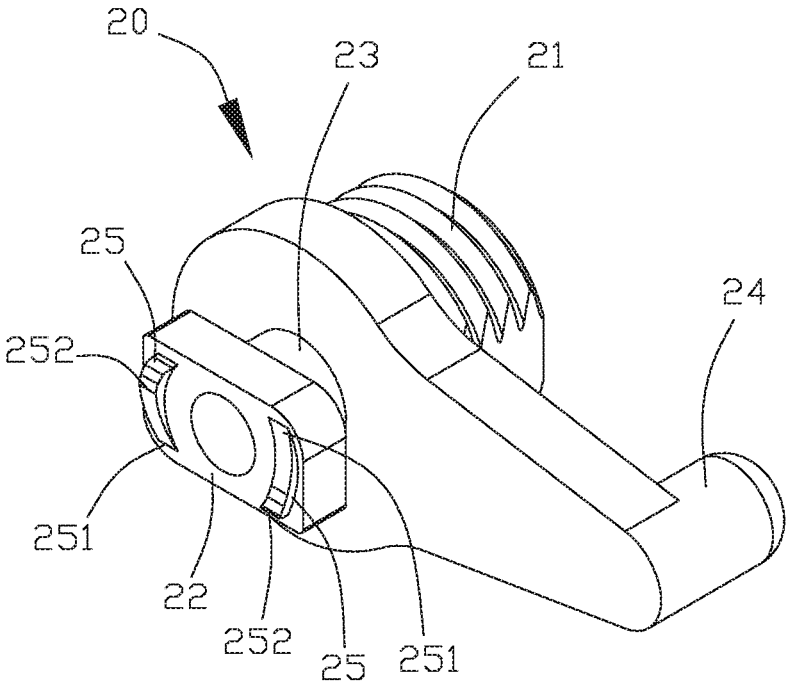
FIG. 4 is a perspective view of a fixture of the lamp holder assembly in accordance with the preferred embodiment of the present invention.

Referring to the drawings and initially to FIGS. 1-4, a lamp holder assembly in accordance with the preferred embodiment of the present invention comprises a support post 10, and a plurality of fixtures (or fixing seats or holders) 20 mounted on the support post 10. The fixtures 20 are used for holding multiple lamps.

The support post 10 has an elongate shape. The support post 10 includes a main body 11 and a securing portion 12 extending from a bottom of the main body 11. The main body 11 has a periphery provided with a plurality of entrance (or guide) slots 13. Each of the entrance slots 13 has two limit grooves 14 formed on two sidewalls thereof. Each of the entrance slots 13 extends through a whole length of the main body 11. The entrance slots 13 construct multiple tracks on the support post 10. The entrance slots 13 are directed toward different directions.

Each of the fixtures 20 includes a mounting head 21 and a locking member 22. The mounting head 21 is used for mounting the lamps. The locking member 22 has a rectangular shape and has a width less than a slot width of each of the entrance slots 13, such that the locking member 22 is introduced into each of the entrance slots 13 in a direction. The locking member 22 has a length more than the slot width of each of the entrance slots 13 and less than a distance between the two limit grooves 14 of each of the entrance slots 13, such that the locking member 22 is introduced from each of the entrance slots 13 into the two limit grooves 14 of each of the entrance slots 13 by rotation of each of the fixtures 20, and is locked in the two limit grooves 14 of each of the entrance slots 13. The locking member 22 is provided with two pressing pieces 25 which are located at two ends of the locking member 22. The locking member 22 is located between the two pressing pieces 25 and the mounting head 21. The two pressing pieces 25 have a thickness increased gradually from a first end (or low end) 251 toward a second end (or high end) 252 thereof in the same rotation direction. Thus, when each of the fixtures 20 is rotated, the two pressing pieces 25 of the locking member 22 are locked into the two limit grooves 14 of each of the entrance slots 13, and each of the fixtures 20 is tightened gradually by a gradual increase in the thickness of the two pressing pieces 25.

In the preferred embodiment of the present invention, each of the two pressing pieces 25 has an arcuate configuration.

In the preferred embodiment of the present invention, the periphery of the main body 11 is provided with a plurality of horizontal cut planes 17 each of which extends axially along the main body 11. The entrance slots 13 are formed in the horizontal cut planes 17.

In the preferred embodiment of the present invention, each of the fixtures 20 further includes a connecting block 23 connecting the mounting head 21 and the locking member 22, and a handle 24 mounted on a side of the mounting head 21.

In the preferred embodiment of the present invention, the main body 11 is provided with a perforation 16 and a plurality of locking holes 15 surrounding the perforation 16. The perforation 16 and the locking holes 15 extend through a whole length of the main body 11. The perforation 16 reduces the weight of the support post 10.

In the preferred embodiment of the present invention, a top cover 30 is mounted on the main body 11 and is provided with a plurality of locking pins 31 locked in the locking holes 15 of the main body 11. A bottom cover 40 is mounted on the main body 11 and is provided with a plurality of locking pins 41 locked in the locking holes 15 of the main body 11. The bottom cover 40 has a center provided with a through hole 42, and the securing portion 12 extends through the through hole 42.

In the preferred embodiment of the present invention, the lamp holder assembly further comprises a plurality of ground insert members 50 mounted on the support post 10, and an insertion head 60 mounted on the support post 10.

In the preferred embodiment of the present invention, the securing portion 12 of the support post 10 is provided with an external thread. The insertion head 60 has an upper end provided with a mounting hole 61 mounted on the securing portion 12 of the support post 10. The mounting hole 61 of the insertion head 60 extends downward in the insertion head 60 and has a peripheral wall provided with an internal thread screwed onto the external thread of the securing portion 12.

In the preferred embodiment of the present invention, each of the ground insert members 50 includes a first plate 51 and a second plate 52 connected with the first plate 51. The first plate 51 has a first end connected with the second plate 52 and a second end provided with a movable hole 53. The securing portion 12 of the support post 10 extends through the movable hole 53 of each of the ground insert members 50.

In the preferred embodiment of the present invention, the first plate 51 and the second plate 52 construct an L-shaped structure.

In the preferred embodiment of the present invention, the top cover 30 is mounted on the top of the support post 10. The bottom cover 40, the ground insert members 50, and the insertion head 60 are mounted on the bottom of the support post 10. The ground insert members 50 are located between bottom cover 40 and the insertion head 60.

Figure 5:
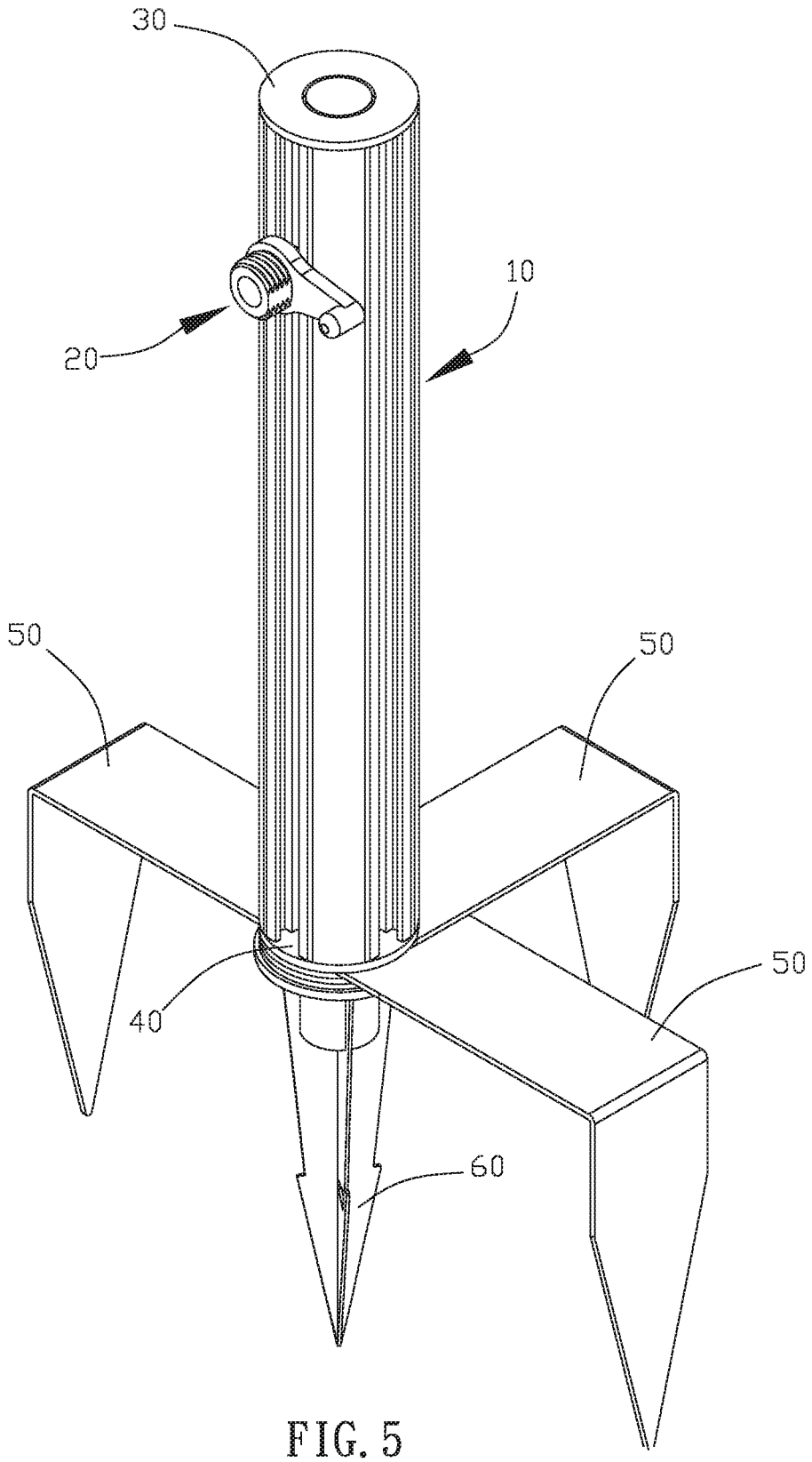
FIG. 5 is a schematic operational view of the lamp holder assembly as shown in FIG. 1 in use.

In practice, referring to FIG. 5 with reference to FIGS. 1-4, the positions of the ground insert members 50 are adjusted to fit the environmental situation. Then, the ground insert members 50 and the insertion head 60 are inserted into the ground to affix the support post 10 to the ground. Then, the fixtures 20 are mounted on the support post 10 according to the required lighting directions and the number of the lamps. Finally, the lamps are mounted on the fixtures 20.

Accordingly, the lamp holder assembly is used to hold multiple lamps simultaneously without having to provide multiple lamp holders, thereby decreasing the cost, and thereby facilitating the user mounting the lamps. In addition, the entrance slots 13 of the support post 10 construct multiple tracks for mounting the lamps and are directed toward different directions so that the lamp holder assembly provides multiple lighting angles to satisfy the user's different requirements. Further, the fixtures 20 are mounted on the support post 10 according to the required lighting directions, the height of installation, and the number of the lamps, such that the lamp holder assembly is available for diverse environmental situations. Further, the two pressing pieces 25 of each of the fixtures 20 are locked into and pressed by the two limit grooves 14 of each of the entrance slots 13, such that each of the fixtures 20 is positioned on the support post 10 steadily. Further, each of the fixtures 20 is mounted on and detached from the support post 10 easily and quickly, thereby facilitating the user assembling and disassembling the lamp holder assembly and the lamps.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A lamp holder assembly comprising:

a support post; and a plurality of fixtures mounted on the support post;

wherein:

the support post includes a main body and a securing portion extending from a bottom of the main body;

the main body has a periphery provided with a plurality of entrance slots;

each of the entrance slots has two limit grooves formed on two sidewalls thereof;

each of the fixtures includes a mounting head and a locking member;

the locking member has a width less than a slot width of each of the entrance slots, with the locking member being introduced into each of the entrance slots in a direction;

the locking member has a length more than the slot width of each of the entrance slots and less than a distance between the two limit grooves of each of the entrance slots, with the locking member being introduced from each of the entrance slots into the two limit grooves of each of the entrance slots by rotation of each of the fixtures, and being locked in the two limit grooves of each of the entrance slots;

the locking member is provided with two pressing pieces;

the two pressing pieces have a thickness increased gradually from a first end toward a second end thereof in the same rotation direction;

when each of the fixtures is rotated, the two pressing pieces of the locking member are locked into the two limit grooves of each of the entrance slots, and each of the fixtures is tightened gradually by a gradual increase in the thickness of the two pressing pieces;

the lamp holder assembly further comprises:

a plurality of ground insert members mounted on the support post; and an insertion head mounted on the support post;

each of the ground insert members includes a first plate and a second plate connected with the first plate;

the first plate has a first end connected with the second plate and a second end provided with a movable hole; and the securing portion of the support post extends through the movable hole of each of the ground insert members.

2. The lamp holder assembly as claimed in claim 1, wherein each of the two pressing pieces has an arcuate configuration.

3. The lamp holder assembly as claimed in claim 1, wherein:

the periphery of the main body is provided with a plurality of horizontal cut planes each of which extends axially along the main body; and the entrance slots are formed in the horizontal cut planes.

4. The lamp holder assembly as claimed in claim 1, wherein each of the fixtures further includes a connecting block connecting the mounting head and the locking member, and a handle mounted on a side of the mounting head.

5. The lamp holder assembly as claimed in claim 1, wherein:

the main body is provided with a perforation and a plurality of locking holes surrounding the perforation; and the perforation and the locking holes extend through a whole length of the main body.

6. The lamp holder assembly as claimed in claim 5, wherein:

a top cover is mounted on the main body and is provided with a plurality of locking pins locked in the locking holes of the main body;

a bottom cover is mounted on the main body and is provided with a plurality of locking pins locked in the locking holes of the main body;

the bottom cover has a center provided with a through hole; and the securing portion extends through the through hole.

7. The lamp holder assembly as claimed in claim 1, wherein:

the securing portion of the support post is provided with an external thread;

the insertion head has an upper end provided with a mounting hole mounted on the securing portion of the support post; and the mounting hole of the insertion head has a peripheral wall provided with an internal thread screwed onto the external thread of the securing portion.

8. The lamp holder assembly as claimed in claim 1, wherein the first plate and the second plate construct an L-shaped structure.

* * * * *